US006987455B2

(12) United States Patent
Kolton et al.

(10) Patent No.: US 6,987,455 B2
(45) Date of Patent: Jan. 17, 2006

(54) ARTICLE SURVEILLANCE UNIT AND ASSEMBLIES THEREWITH

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/097,208

(22) Filed: Mar. 13, 2002

(65) Prior Publication Data

US 2003/0174058 A1 Sep. 18, 2003

(51) Int. Cl.
*G08B 13/14* (2006.01)

(52) U.S. Cl. ..... 340/572.8; 340/568.1; 340/571; 340/572.1; 340/572.9; 40/299.01; D10/104

(58) Field of Classification Search ..... 340/572.8, 340/572.1, 572.4, 572.9, 568.1, 571, 572.6, 340/539.1, 539.31, 572.3; 40/299.01, 625; D10/104, 106

See application file for complete search history.

(56) References Cited

U.S. PATENT DOCUMENTS

| | | | | | |
|---|---|---|---|---|---|
| 6,072,394 | A | * | 6/2000 | Hasegawa et al. | 340/572 |
| 6,137,413 | A | * | 10/2000 | Ryan, Jr. | 340/572.8 |
| 6,142,347 | A | * | 11/2000 | Koloton et al. | 223/85 |
| 6,170,088 | B1 | * | 1/2001 | Tate | 2/209.13 |
| 6,191,691 | B1 | * | 2/2001 | Serrault | 340/572.8 |
| 6,254,953 | B1 | * | 7/2001 | Elston | 340/572.8 |
| 6,475,443 | B1 | * | 11/2002 | van Deursen et al. | 422/102 |
| 6,693,542 | B2 | * | 2/2004 | Hasegawa | 340/572.8 |

* cited by examiner

*Primary Examiner*—Davetta W. Goins
(74) *Attorney, Agent, or Firm*—Cowan, Liebowitz & Latman, P.C.

(57) ABSTRACT

One assembly includes an article of manufacture having an exterior surface of a given color and an EAS marker-containing housing secured to the article and defining an exterior surface of the given color. Another assembly includes an article of manufacture having an exterior surface with a surface section of a given configuration and an EAS marker-containing housing secured to the article and defining an exterior surface having surface section contiguous with the article surface section and of the given configuration.

10 Claims, 3 Drawing Sheets

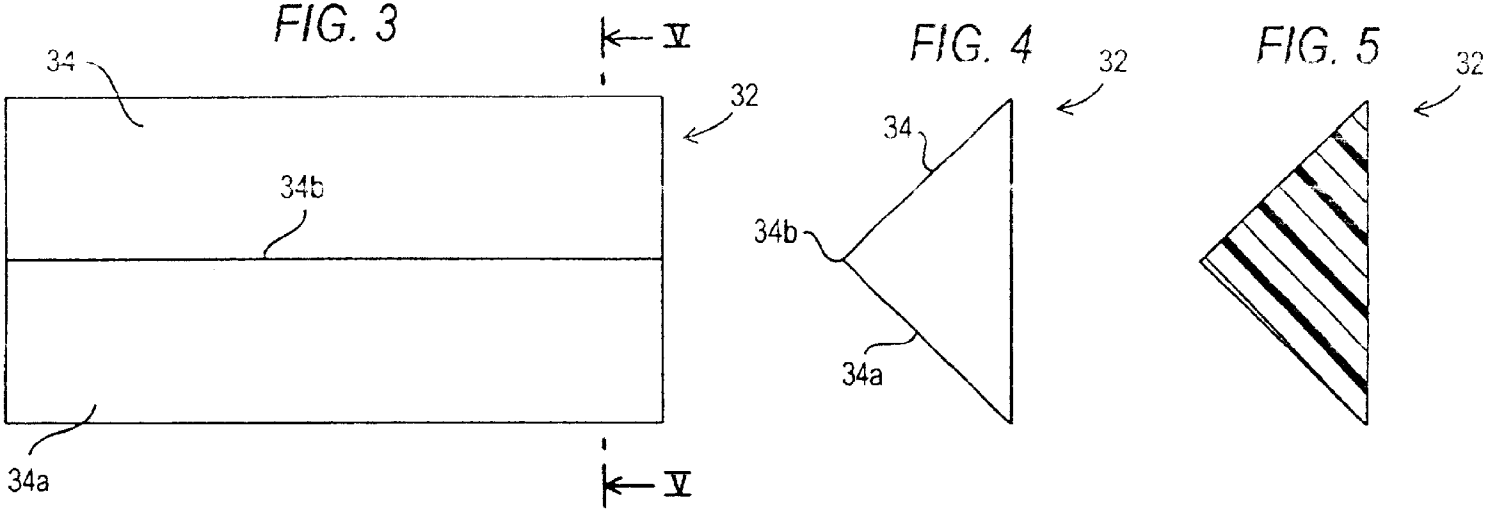
FIG. 3
FIG. 4
FIG. 5
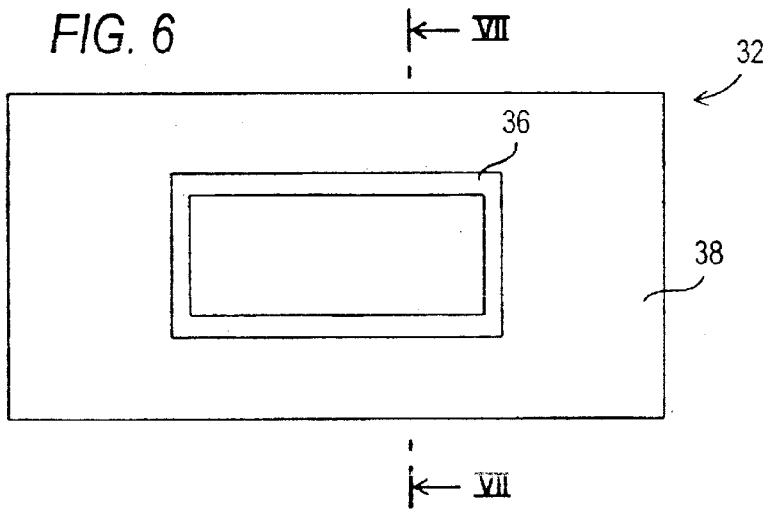
FIG. 6
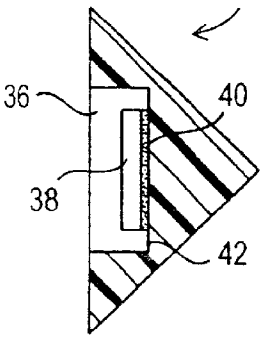
FIG. 7

ARTICLE SURVEILLANCE UNIT AND ASSEMBLIES THEREWITH

FIELD OF THE INVENTION

This invention relates generally to security from shoplifting of articles of manufacture and pertains more particularly to electronic article surveillance (EAS) marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

In commonly-assigned U.S. Pat. No. 5,998,462, a garment hanger is disclosed which overcomes the foregoing disadvantages. Therein, a garment hanger is set forth which is comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS marker.

Other solutions to the above-noted problem provide for the EAS marker to be contained in a housings securable to articles of manufacture, wherein the housings render the EAS marker not viewable.

SUMMARY OF THE INVENTION

The present invention has as its primary object the provision of improved EAS marker application to articles of manufacture.

A more particular object of the invention is to provide EAS marker-containing housings which blend with articles of manufacture and accordingly are less noticeable.

In attaining the foregoing and other objects, in one aspect, the invention provides, in combination, an article of manufacture having an exterior surface of a given color and an EAS marker-containing housing secured to the article and defining an exterior surface of the given color.

In another aspect, the invention provides in combination, an article of manufacture having an exterior surface with a surface section of a given configuration and an EAS marker-containing housing secured to the article and defining an exterior surface having surface section contiguous with the article surface section and of the given configuration.

More particularly, in such other aspect, the invention provides, in combination, in combination, an article of manufacture having an exterior surface defining successive first and second intersecting surface sections and an EAS marker-containing housing secured to the article and defining an exterior surface defining first and second successive intersecting surface sections, the housing first surface section being continuous with the article first surface section, the housing second surface section being in facing relation to the article second surface section.

The foregoing and other objects and features of the invention will be further evident from the following detailed description of preferred embodiments thereof and from the drawings in which like components are identified by like reference numerals throughout.

DESCRIPTION OF THE DRAWINGS

FIG. 3 is a elevation of the housing of FIGS. 1 and 2 standing on an end thereof.

FIG. 4 is a right side elevation of FIG. 3.

FIG. 5 is a sectional view of the FIG. 3 housing as would be seen from plane V—V of FIG. 3.

FIG. 6 is a rear elevation of FIG. 3.

FIG. 7 is a sectional view of the FIG. 3 housing as would be seen from plane VII—VII of FIG. 6.

DETAILED DESCRIPTION OF PREFERRED EMBODIMENTS AND PRACTICES

Figure 2:
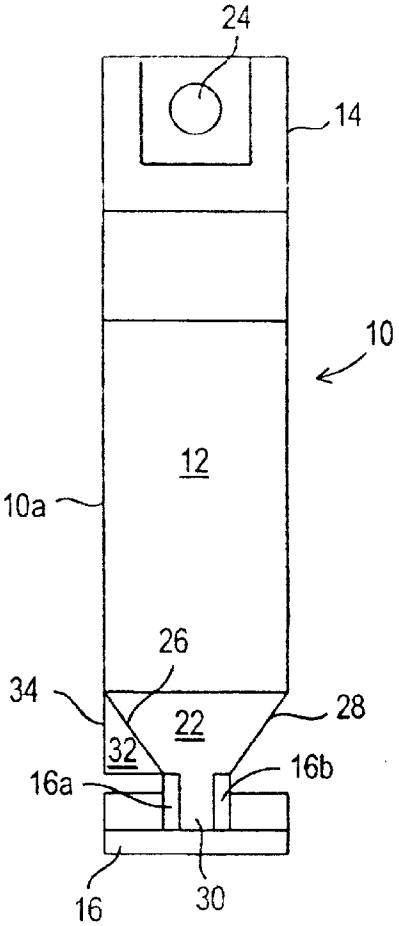
FIG. 2 is a right side elevation of FIG. 1.
Figure 1:
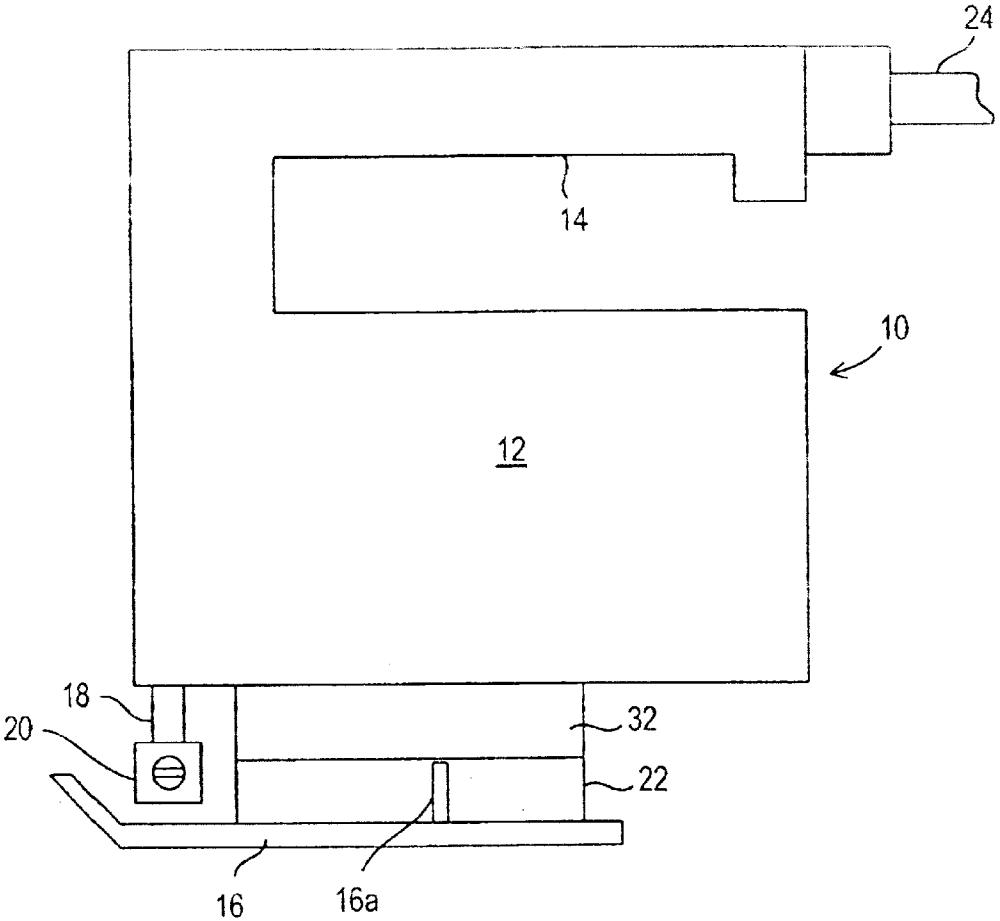
FIG. 1 is a side elevation of an electric drill equipped with an EAS member-containing housing in accordance with the invention.

Referring to FIGS. 1 and 2, electric drill 10 includes housing 12 defining handle 14, bottom plate 16, drive shaft 18 and saw tooth securement member 20. Bottom plate 16 is secured to housing base 22 by bottom plate flanges 16*a* and 16*b*. Electrical cable 24 furnishes power to drill 10.

Housing base 22 includes inwardly tapered surfaces 26 and 28 and a lowermost part 30 extending downwardly of surfaces 26 and 28 to abut bottom plate 16. Components 12–30 are present in commercially-available electrical drills, e.g., as in a Black & Decker drill—Variable Jig Saw—, the housing of which is colored throughout in orange.

EAS member-containing housing 32 is applied adhesively to surface 26 (or surface 28) and is configured such that exterior surface 34 of housing 32 is rectilinearly continuous with front wall 10*a* of drill 10. Further, per the invention, housing 32 is preferably of common color with the drill housing color, e.g., orange in the case of the referenced commercially-available drill.

Referring now to FIGS. 3–7, housing 32 is a generally solid body of molded plastic defining recess 36 accessible through rear surface 38 of housing 32. EAS member 38 is secured by adhesive layer 40 to surface 42 of housing 32, i.e., the ceiling of recess 36. As is seen in FIG. 4, housing 32 is of triangular configuration with surface 34*a* and 34*b* intersecting one another at apex 34*b*.

Figure 9:
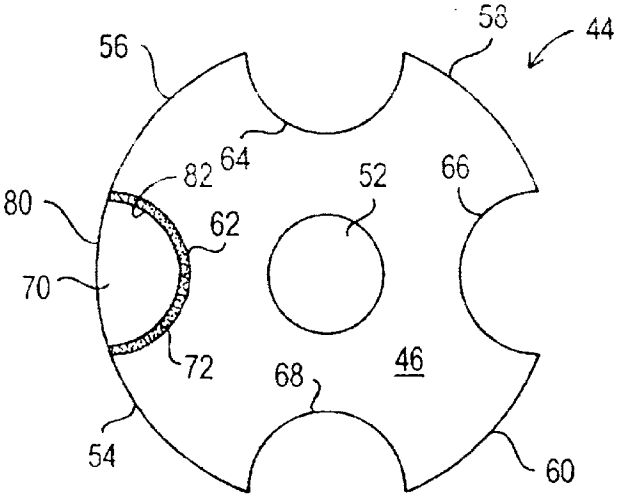
FIG. 9 is a right side elevation of FIG. 8.
Figure 11:
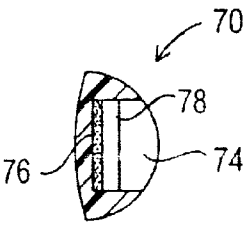
FIG. 11 is a sectional view of the FIG. 10 housing as would be seen from plane XI—XI of FIG. 10.
Figure 8:
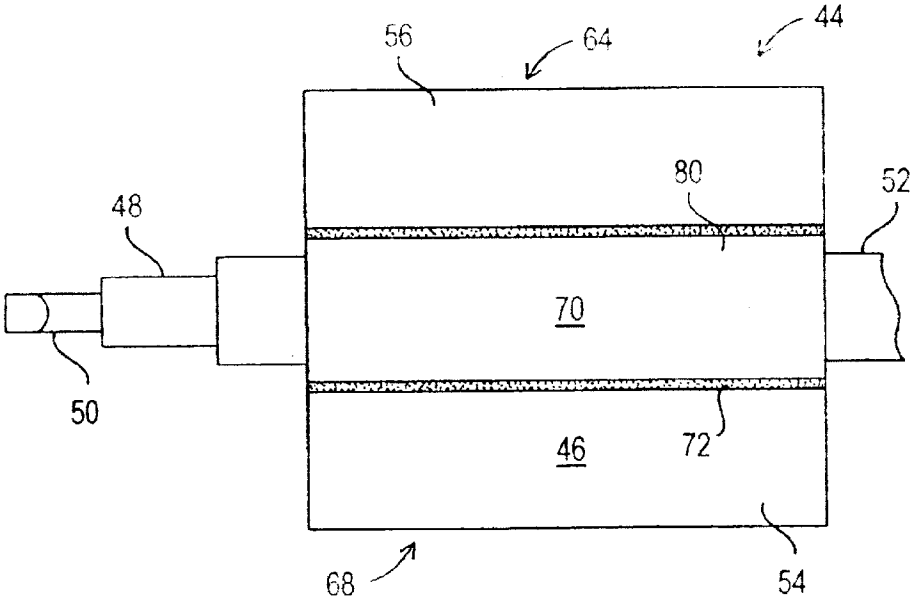
FIG. 8 is a side elevation of an electric screwdriver equipped with an EAS member-containing housing in accordance with the invention.
Figure 10:
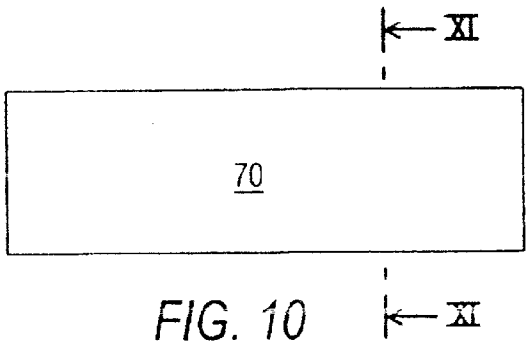
FIG. 10 is a elevation of the housing of FIGS. 8 and 9 standing on an end thereof.

Turning to FIGS. 8–11, electric screwdriver 44 includes housing 46, drive shaft 48 and screwdriving bit 50 and is electrically powered through cable 52. As is seen in FIG. 9, housing 46 has outer circular segments 54, 56, 58 and 60 and circular indentations 62, 64, 66 and 68 formed to assist gripping of housing 46.

Per the invention, EAS member-containing housing 70 is seated in indentation 62 and is adhesively secured therein by adhesive layer 72. Housing 70 is a generally solid body of molded plastic defining recess 74 accessible through the rear surface of housing 70. Adhesive layer 76 secures EAS member 78 to the interior surface of recess 74.

Exterior surface 80 of housing 70 is circularly continuous with circular segments 54 and 56 of screwdriver housing 46. Surface 82 of housing 70 will be seen to be in intersecting relation with surface 80 of housing 70.

Further, per the invention, housing 70 is preferably of common color with the screwdriver housing color, e.g., green.

As will be seen generally from the foregoing and by way of introduction to the ensuing claims, the invention provides in combination, an article of manufacture having an exterior surface defining successive first and second intersecting surface sections and an EAS marker-containing housing secured to the article and defining an exterior surface defining first and second successive intersecting surface sections. The housing first surface section is continuous with the article first surface section and the housing second surface section is in facing relation to the article second surface section.

The article first surface section may be a rectilinearly-extending surface section and the housing first surface section then extends rectilinearly with the article first surface section. The article second surface section is then a rectilinearly-extending surface section and the housing second surface section then extends rectilinearly in facing relation with the article second surface section.

The article first surface section may be a circularly-extending surface section and the housing first surface section then extends circularly with the article first surface section. The article second surface section is then a circularly-extending surface section and the housing second surface section then extends circularly in facing relation with the article second surface section.

Various changes to the particularly disclosed embodiments and practices may evidently be introduced without departing from the invention. For example, the article of manufacture may define a rectangular trough, with the EAS member-containing housing of like rectangular configuration, with the exterior surfaces of the article and the EAS member-containing housing in contiguous alignment. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination:

an article of manufacture having an exterior surface defining successive first and second intersecting surface sections; and a housing secured to said article and defining an exterior surface defining first and second successive intersecting surface sections, said housing first surface section being a part of said exterior surface of said article of manufacture;

said housing first surface section being continuous with said article first surface section, said housing second surface section being in facing relation to said article second surface section, said housing defining a recess, and an EAS-marker being disposed in said housing recess.

2. The invention claimed in claim 1, wherein said article first surface section is a rectilinearly-extending surface section and wherein said housing first surface section extends rectilinearly with said article first surface section.

3. The invention claimed in claim 1, wherein said article second surface section is a rectilinearly-extending surface section and wherein said housing second surface section extends rectilinearly in facing relation with said article second surface section.

4. The invention claimed in claim 2, wherein maid article second surface section is a rectilinearly-extending surface section and wherein said housing second surface section extends rectilinearly in facing relation with said article second surface section.

5. The invention claimed in claim 1, wherein said article first surface section is a circularly-extending surface section and wherein said housing first surface section extends circularly with said article first surface section.

6. The invention claimed in claim 5, wherein said article second surface section is a circularly-extending surface section and wherein said housing second surface section extends circularly in facing relation with said article second surface section.

7. The invention claimed in claim 6, wherein said article second surface section is a circularly-extending surface section and wherein said housing second surface section extends circularly in facing relation with said article second surface section.

8. The invention claimed in claim 1, wherein said article first surface section and said housing first surface section are of a same color.

9. In combination:

an article of manufacture having an exterior surface of a given color, and an EAS marker-containing housing secured to said article and defining an exterior surface of said given color, said exterior surface of said EAS marker-containing housing being continuous with and forming a part of said exterior surface of said article of manufacture.

10. In combination:

an article of manufacture having an exterior surface with a surface section of a given configuration; and a housing secured to said article and defining an exterior surface having a surface section continuous with said article surface section and of said given configuration, said housing surface section forming a part of said exterior surface of said article of manufacture; and an EAS-marker being disposed in said housing.

* * * * *

UNITED STATES PATENT AND TRADEMARK OFFICE

CERTIFICATE OF CORRECTION

PATENT NO. : 6,987,455 B2
APPLICATION NO. : 10/097208
DATED : January 17, 2006
INVENTOR(S) : Kolton et al.

It is certified that error appears in the above-identified patent and that said Letters Patent is hereby corrected as shown below:

At column 1, line 35, the printed patent incorrectly reads“ contained ina housings”; the patent should read --contained in housings--.

At column 1, line 59, the printed patent incorrectly reads “provides, in combination, in combination, an article”; the patent should read --provides, in combination, an article--.

At column 4, line 17 (claim 14), the printed patent incorrectly reads “wherein maid article”; the patent should read --wherein said article--.

Signed and Sealed this

Twenty-first Day of August, 2007

JON W. DUDAS
*Director of the United States Patent and Trademark Office*